US010260359B2

(12) United States Patent
Groom et al.

(10) Patent No.: US 10,260,359 B2
(45) Date of Patent: Apr. 16, 2019

(54) VANE

(71) Applicant: ROLLS-ROYCE plc, London (GB)

(72) Inventors: Alec R. Groom, Bristol (GB); Andrew J. Ure, Rugby (GB); Christopher S. Avenell, Bristol (GB)

(73) Assignee: ROLLS-ROYCE plc, London (GB)

( * ) Notice: Subject to any disclaimer, the term of this patent is extended or adjusted under 35 U.S.C. 154(b) by 330 days.

(21) Appl. No.: 15/051,015

(22) Filed: Feb. 23, 2016

(65) Prior Publication Data

US 2016/0273371 A1 Sep. 22, 2016

(30) Foreign Application Priority Data

Mar. 18, 2015 (GB) ..... 1504522.2

(51) Int. Cl.
*F01D 5/18* (2006.01)
*F01D 9/02* (2006.01)
*F01D 5/14* (2006.01)

(52) U.S. Cl.
CPC ..... *F01D 9/023* (2013.01); *F01D 5/147* (2013.01); *F01D 5/189* (2013.01); *F05D 2240/121* (2013.01); *F05D 2260/201* (2013.01); *F05D 2260/202* (2013.01)

(58) Field of Classification Search
CPC ..... F01D 5/147; F01D 5/187; F01D 5/188; F01D 5/189; F01D 9/02; F01D 9/023; F05D 2240/121; F05D 2260/201; F05D 2260/202
See application file for complete search history.

(56) References Cited

U.S. PATENT DOCUMENTS

| | | | |
|---|---|---|---|
| 2,827,760 | A | 3/1958 | Marchant et al. |
| 3,412,979 | A | 11/1968 | Davies |
| 3,574,481 | A | 4/1971 | Pyne, Jr. et al. |
| 3,767,322 | A | 10/1973 | Durgin et al. |
| 3,806,275 | A | 4/1974 | Aspinwall |

(Continued)

FOREIGN PATENT DOCUMENTS

| | | | |
|---|---|---|---|
| DE | 102009044103 | A1 | 6/2010 |
| EP | 0534586 | A1 | 3/1993 |

(Continued)

OTHER PUBLICATIONS

Aug. 17, 2015 Search Report issued in British Patent Application No. 1504522.2.

(Continued)

*Primary Examiner* — Carlos A Rivera
*Assistant Examiner* — Sang K Kim
(74) *Attorney, Agent, or Firm* — Oliff PLC

(57) ABSTRACT

A vane for an exhaust system duct in a gas turbine engine including a vane plate, a guide plate, and a baffle. The vane plate includes a leading edge, a first leg and a second leg, with the first and second legs respectively extending on opposing sides of the leading edge to form a substantially U-shaped profile. The baffle connects respective distal ends of the first and second legs. The guide plate is accommodated within the vane plate, and includes a first aperture extending along the guide plate and aligned with the leading edge. The vane further includes a fluid inlet arranged, in use, to direct a fluid flow from outside the duct into an interior of the vane.

13 Claims, 7 Drawing Sheets

(56) References Cited

U.S. PATENT DOCUMENTS

| | | | | |
|---|---|---|---|---|
| 4,292,008 | A | 9/1981 | Grosjean et al. | |
| 5,100,293 | A * | 3/1992 | Anzai | F01D 5/186 416/96 A |
| 5,203,873 | A * | 4/1993 | Corsmeier | F01D 5/147 416/96 A |
| 5,591,002 | A * | 1/1997 | Cunha | F01D 5/187 415/115 |
| 2003/0031555 | A1* | 2/2003 | Noe | F01D 5/189 415/115 |
| 2010/0132374 | A1 | 6/2010 | Manteiga et al. | |
| 2014/0075947 | A1 | 3/2014 | Gautschi et al. | |
| 2016/0097286 | A1* | 4/2016 | Tibbott | F01D 5/188 415/1 |

FOREIGN PATENT DOCUMENTS

| | | | |
|---|---|---|---|
| GB | 2467790 | A | 8/2010 |
| JP | S60-182302 | A | 9/1985 |

OTHER PUBLICATIONS

Jul. 13, 2016 Search Report issued in European Patent Application No. 16156490.

* cited by examiner

SECTION A-A

VANE

This disclosure claims the benefit of UK Patent Application No. GB1504522.2, filed on 18 Mar. 2015, which is hereby incorporated herein in its entirety.

FIELD OF THE DISCLOSURE

The present disclosure relates to a vane and particularly, but not exclusively, to a vane for the exhaust system of a gas turbine engine.

BACKGROUND TO THE DISCLOSURE

In the exhaust duct of a conventional aerospace gas turbine engine a plurality of vanes or struts are attached to the duct casing and extend between walls of the duct, to support the duct and to maintain its shape. These so-called "exit guide vanes" are disposed in the path of hot exhaust gases from the engine and so are prone to becoming very hot themselves. To combat the effects of overheating, the vane is designed as a hollow structure which allows the flow of cooling air in its interior.

It is known to provide cooling air flows to stators and rotor vanes using high pressure air bleeds drawn from the engine's compressor. Due to the relative pressure drop between the compressor bleed and the region to which the cooling air flow is provided, highly effective heat transfer can be achieved, albeit with high pressure losses.

Where a significant pressure drop does not exist, highly effective heat transfer features with high pressure losses cannot be used. Turning the flow and adequately conditioning it to maximise cooling effectiveness is therefore difficult. Where the hot core flow impinges onto the vane leading edge tip, its high static pressure further decreases the available pressure difference relative to the bypass air. Film cooling the hot surface of the vane leading edge is therefore impossible.

Whereas the high pressure drop between the compressor supply and the coolant exit makes for very effective cooling in vanes which are actively cooled in this way, vanes which are cooled with scooped bypass air, at lower pressure, are less effectively cooled. The reason that so-called scoop-fed vanes are less effectively cooled is that the flow of cooling air is relatively low and little or no attempt has been made to control the internal flow path. The pressure drop available is insufficient to ensure that the cooling air will change direction sufficiently to flow along the internal surfaces of the vane. Accordingly, there are areas of the vane that are not cooled, or are cooled insufficiently. This can lead to uneven thermal expansion of certain parts and possibly overheating of the internal load bearing structure, by heat convection and radiation.

An example of the cooling arrangement of a vane in the turbine section of an engine, utilising only low pressure bypass air is provided in GB2467790B.

STATEMENTS OF DISCLOSURE

According to a first aspect of the present disclosure there is provided a vane for an exhaust system duct in a gas turbine engine, the vane comprising:

a vane plate;

a guide plate; and a baffle, wherein the vane plate comprises a leading edge, a first leg and a second leg, the first and second legs respectively extending on opposing sides of the leading edge to form a substantially U-shaped profile, the guide plate being accommodated within the vane plate, the baffle connecting respective distal ends of the first and second legs, the guide plate comprising a first aperture extending along the guide plate and being aligned with the leading edge, the vane further comprising a fluid inlet arranged, in use, to direct a fluid flow from outside the duct into an interior of the vane.

Bypass air is fed into the duct and directed to the leading edge of the vane outer skin via the first aperture in the guide plate, before it then passes along a channel between the vane plate and the guide plate.

The first aperture focuses the cooling flow at the leading edge of the vane where heat input from the hot core flow is greatest, to thereby provide cooling to the highest temperature region of the vane plate.

After impinging on the inner surface of the vane plate, the cooling flow passes along the channel between the vane plate and the guide plate. The cooling flow cools the vane plate by convection and thereby limits the transfer of heat energy from the vane plate to the guide plate.

By arranging the first aperture to extend along the guide plate aligned with the leading edge, the length of the flow path taken by the cooling flow as it passes through the first aperture and along the interior surface of the vane plate may be minimised. This results in the temperature of the cooling flow being reduced, and provides for a more even distribution of temperature reduction to the vane plate.

Optionally, the first aperture is formed as a slot extending axially along the guide plate.

In one arrangement, the first aperture extends along the full axial length of the guide plate. In other arrangements, the first aperture may extend along only a part of the axial length of the guide plate.

Optionally, the slot has a streamlined cross-sectional profile.

The presence of a streamlined cross-sectional profile at the slot may assist in avoiding separation of the cooling flow entering and exiting the slot. This reduces the flow losses through the vane and makes the vane more aerodynamically efficient.

Optionally, the slot has a width of between approximately 1 mm and 3 mm.

In one arrangement, the slot has a lateral width of approximately 2 mm. In other arrangements, the slot may have an alternative lateral width.

Optionally, the slot has a width that varies along the axial extent of the slot.

In one arrangement, the slot has a lateral width that has a maximum value at each axial end of the guide plate, and narrows linearly to a minimum value at an axial mid-point of the guide plate. This arrangement provides for increased cooling air flows at end axial end of the guide plate relative to the cooling air flow at the mid-point of the guide plate.

In other arrangements, the geometry of the slot may have another linear (i.e. tapered from one end of the guide plate to the other) or non-linear form.

Optionally, the slot comprises a plurality of slots arranged axially along the guide plate.

In another arrangement, the slot is formed as a plurality of axially arranged slots. A guide plate having this arrangement may be simpler and more cost effective to manufacture than one having a single axially extending slot.

Optionally, the first aperture is formed as a plurality of perforations extending axially along the guide plate.

In a further arrangement, the slot may be formed as a plurality of perforations extending axially along the leading edge of the guide plate. This arrangement may be simpler and more cost effective to manufacture than one having a single axially extending slot.

Optionally, the baffle is formed as a porous plate.

A cooling air flow may be required to cool the downstream vane body. Since the incoming cooling air is fast moving, it cannot be efficiently directed to the downstream vane body. This results in a separation zone behind, or downstream of, the vane where there is insufficient cooling air flow.

Consequently, the downstream vane cavity may be provided with cooling air via a porous baffle in order to combat the separation around the vane.

Optionally, the porosity of the baffle varies along the axial extent of the baffle.

The volume of cooling flow passing through the baffle may be controlled by varying the porosity of the baffle.

The distribution of the cooling flow passing through the baffle may be controlled by varying the porosity of the baffle along the axial extent of the baffle. This enables the cooling flow through the baffle to be tuned to counteract asymmetric separation behind the vane or to direct cooling flow at specific features within the vane body.

Optionally, the vane further comprises a vane body and first and second exhaust apertures, the vane body having opposing first and second surfaces, the first and second surfaces being contiguous with respective first and second legs of the vane plate, the first exhaust aperture being positioned at a juncture of the first surface and the first leg, and the second exhaust aperture being positioned at a juncture of the second surface and the second leg.

In one arrangement, the cooling flow exits from the channel between the vane plate and the guide plate, to the engine core flow, through a slot at the distal end of each of the first and second legs of the vane plate. This aids the formation of a cooling film over the surfaces of the vane body for downstream vane walls where necessary.

Optionally, each of the first and second exhaust apertures comprises a slot extending axially along the vane, each slot being arranged to direct a fluid flow from a gap between the vane plate and the guide plate, over respective ones of the first and second surfaces.

The size of the slots forming the first and second exhaust apertures can be varied to control the proportion of cooling air that passes through the channel between the vane plate and the guide plate, and that which passes through the porous baffle.

Optionally, each of the first and second exhaust apertures comprises a slot extending axially along the vane, each slot being arranged to direct a fluid flow from a gap between the vane plate and the guide plate, into a cavity defined between the first and second surfaces of the vane body.

In another arrangement, the cooling flow exiting the channels between the vane plate and the guide plate may be directed into the interior of the vane body. This may provide for additional cooling of the downstream region of the vane body.

Optionally, each of the first and second exhaust apertures comprises a plurality of perforations extending axially along the vane, each plurality of perforations being arranged to direct a fluid flow from a gap between the vane plate and the guide plate, over respective ones of the first and second surfaces.

This arrangement may direct the cooling flow exiting the channels between the vane plate and the guide plate across the first and second surfaces of the vane body. This may assist in the formation of a film for the cooling of the vane body surfaces. This in turn may increase the cooling effectiveness of the vane.

In an alternative arrangement, the plurality of perforations may extend over substantially the entire surface of the guide plate.

Optionally, the fluid inlet comprises at least one scoop element arranged to direct a bypass fluid flow from outside the duct into the interior of the vane.

In one arrangement, the fluid inlet comprises a single scoop element arranged to direct a bypass fluid flow from outside the duct into one end of the vane.

The single scoop element may have the same entry cross-sectional area as that of the first aperture.

Alternatively, the entry cross-sectional area of the single scoop element may be different to that of the first aperture, with the scoop element providing for a transition in cross-sectional area between its inlet and its outlet.

In another arrangement, the fluid inlet comprises two scoop elements, each scoop element arranged to direct a bypass fluid flow from outside the duct into a respective one of the two ends of the vane.

Optionally, the vane further comprises at least one flow guide element arranged to direct a fluid flow from outside the duct through the first aperture and into a gap between the vane plate and the guide plate.

Flow guides may be used to direct the flow entering the interior of the vane from the scoop element from its initial orientation normal to the axis of the first aperture to the desired orientation parallel to the axis of the first aperture.

The flow guides may also provide for a distribution of the cooling flow along the axial length of the first aperture.

The flow guides may also assist with any flow expansion that may be required as the cooling flow passes from the scoop element to the first aperture.

According to a second aspect of the present disclosure there is provided a gas turbine engine comprising a vane in accordance with the first aspect of the disclosure.

Other aspects of the disclosure provide devices, methods and systems which include and/or implement some or all of the actions described herein. The illustrative aspects of the disclosure are designed to solve one or more of the problems herein described and/or one or more other problems not discussed.

BRIEF DESCRIPTION OF THE DRAWINGS

There now follows a description of an embodiment of the disclosure, by way of non-limiting example, with reference being made to the accompanying drawings in which.

It is noted that the drawings may not be to scale. The drawings are intended to depict only typical aspects of the disclosure, and therefore should not be considered as limiting the scope of the disclosure. In the drawings, like numbering represents like elements between the drawings.

DETAILED DESCRIPTION

Figure 1:
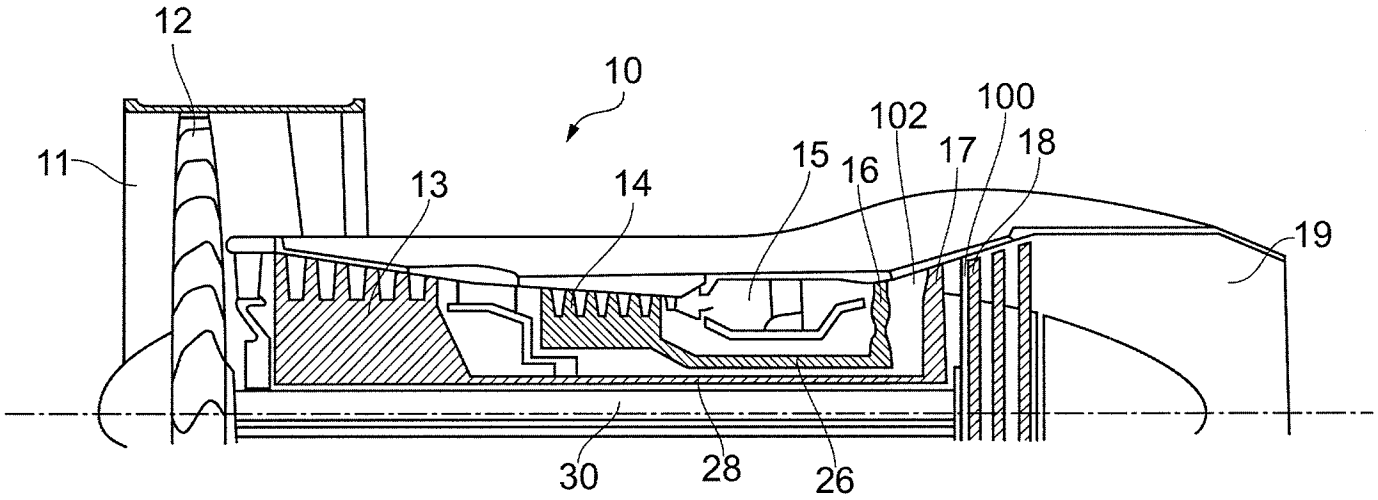
FIG. 1 shows a schematic sectional view of a gas turbine engine comprising a vane according to an embodiment of the disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. An array of vanes 100 are provided in a duct 102 between the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

Figure 2:
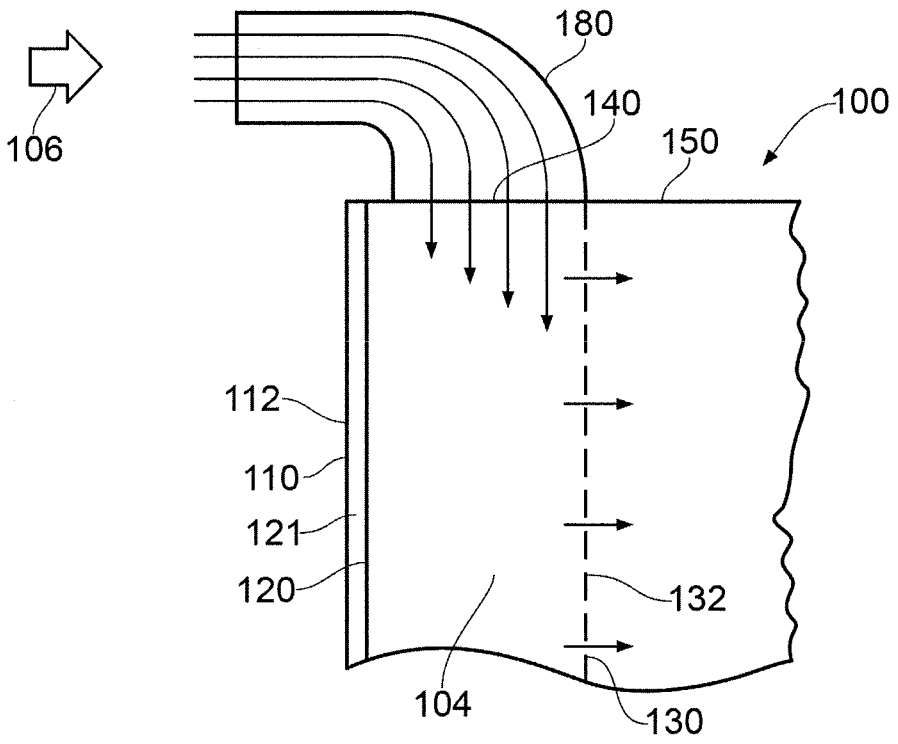
FIG. 2 shows a schematic cross-sectional view of a vane according to the first embodiment of the disclosure.
Figure 3:
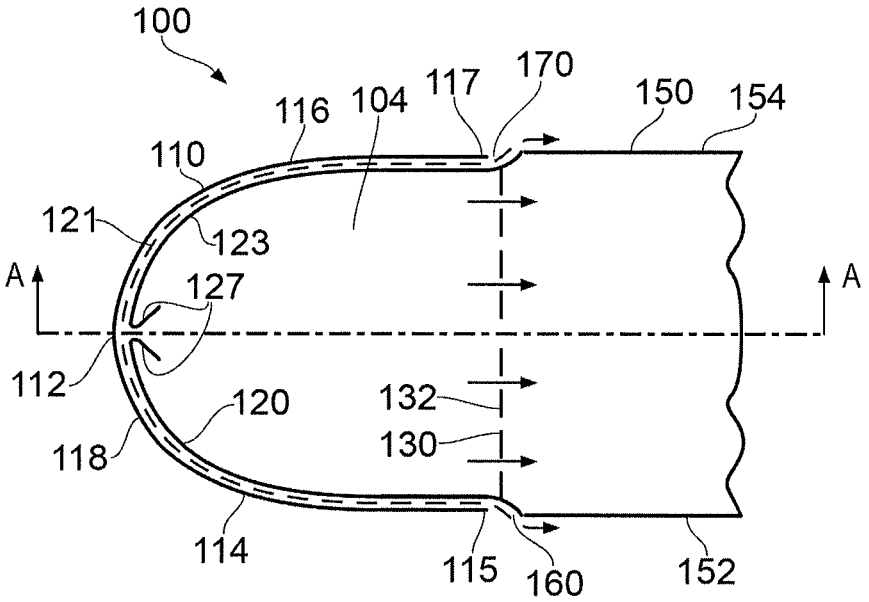
FIG. 3 shows a schematic sectional plan view of the vane of FIG. 2.
Figure 4:
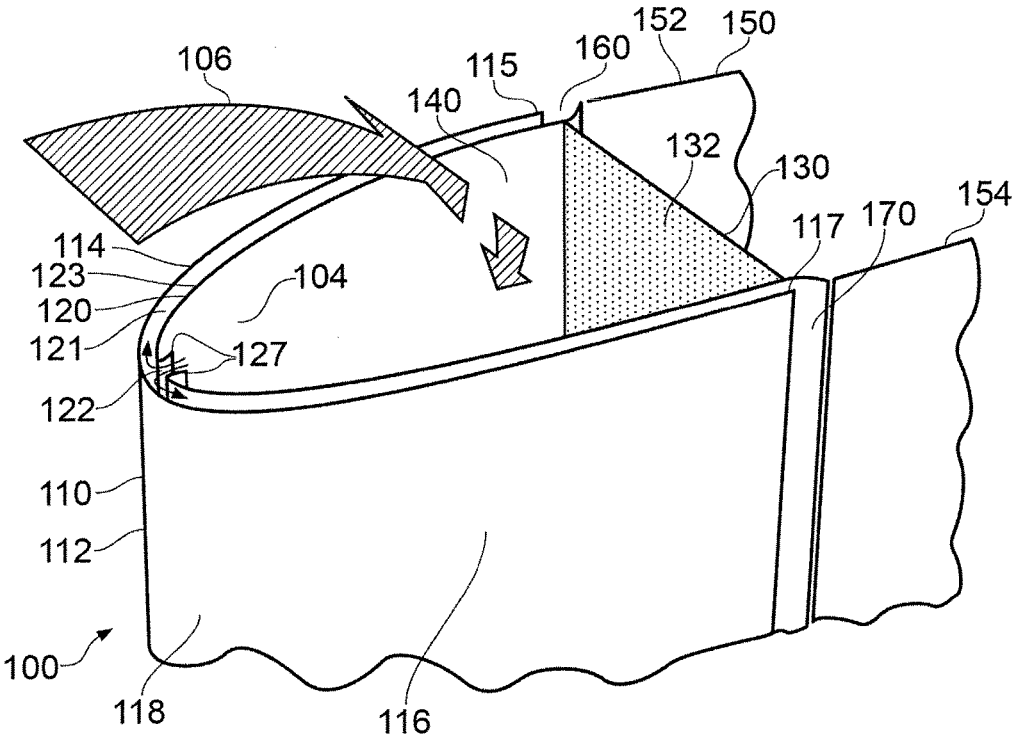
FIG. 4 shows a partial perspective view of the vane of FIG. 2.

Referring to FIGS. 2 to 4, a vane according to a first embodiment of the disclosure is designated generally by the reference numeral 100.

In this arrangement, the vane 100 forms part of the circumferential vane array (not shown) of vanes 100 that are positioned in the duct 102 between the intermediate pressure turbine 17 and the low pressure turbine 18. In other arrangements, the vane array may be positioned at another location in the turbine portion of the engine. Alternatively, the vane array may be located within the compressor portion of the engine.

The vane 100 comprises a vane plate 110, a guide plate 120 and a baffle 130. The vane plate 110 comprises a leading edge 112, a first leg 114 and a second leg 116. The first leg 114 and the second leg 116 respectively extend on opposing sides of the leading edge 112 to form a substantially U-shaped cross-sectional profile 118.

The guide plate 120 has a substantially U-shaped cross-sectional profile 123, and is accommodated within the vane plate 110. The guide plate 120 is offset from the vane plate 110 such that a gap 121 is maintained between the vane plate 110 and guide plate 120.

The baffle 130 is positioned to extend between the distal end 115 of the first leg 114, and the distal end 117 of the second leg 116. The guide plate 120 and the baffle 130 together define the interior 104 of the vane 100.

Figure 5:
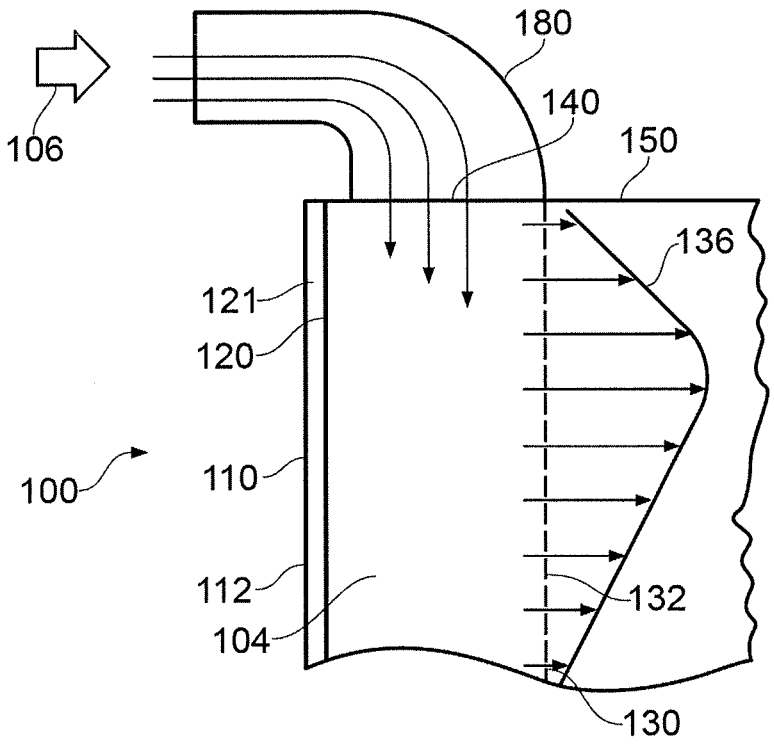
FIG. 5 shows the cross-sectional view of FIG. 2 with a baffle having a variable porosity.

In the present embodiment the baffle 130 is formed as a porous plate 132 having an asymmetric distribution of porosity across its axial length. In other words, the porosity increases from a base value at one end of the baffle 130 towards a maximum value close to the mid-point of the baffle 130, and then decreases to the base value at the opposite end of the 4 baffle 130. FIG. 5 shows figuratively how the distribution of porosity 136 varies across the axial length of the baffle 130.

The guide plate 120 further comprises a first aperture 122 extending along the guide plate 120 and being aligned with the leading edge 112.

The vane 100 further comprises a fluid inlet 140 that is positioned at one end of the vane 100 and directs a fluid flow from outside the duct 102 into an interior 104 of the vane 100. In the present arrangement the fluid flow 106 is provided to the fluid inlet 140 through a scoop element 180. The scoop element 180 is positioned to receive a fluid flow 106 from the bypass flow of the engine.

The first aperture 122 is formed as a slot 124 extending axially along the length of the guide plate 120. The slot 124 has a constant width 126 and extends axially along substantially the entire length of the guide plate 120. In the present embodiment the width 126 of the slot 124 is 2 mm.

The slot 124 has a streamlined cross-sectional profile 127. In other words, the edges of the slot 124 are curved around to extend into the interior 104 of the vane 100.

The vane 100 further comprises a vane body 150 that is positioned behind, or downstream of, the baffle 130. The vane body 150 has a first surface 152 and an opposite second surface 154. The first surface 152 is contiguous with the first leg 114 of the vane plate 110, while the second surface 154 is contiguous with the second leg 116 of the vane plate 110.

A first exhaust aperture 160 is positioned at the juncture of the first surface 152 and the distal end 115 of the first leg 144. A second exhaust aperture 170 is positioned at the juncture of the second surface 154 and the distal end 117 of the second leg 116. Both the first exhaust aperture 160 and the second exhaust aperture 170 are formed as linear slots extending axially along the respective juncture between the fills and second surfaces 152,154, and the first and second legs 114,116.

Each of the first and second exhaust apertures 160,170 is arranged to direct a fluid flow from the gap 121 between the vane plate 110 and the guide plate 120, over respective ones of the first and second surfaces 152, 154 of the vane body 150.

In use the fluid flow 106 is directed through the scoop element 180 into the interior 104 of the vane 100. From the interior 104 of the vane 100, part of the fluid flow 106 passes through the slot 124 and into the gap 121 between the vane plate 110 and the guide plate 120. The remainder of the fluid flow 106 passes through the porous plate 132 and into the interior of the vane body 150.

The distribution of the fluid flow 106 between the slot 124 and the porous plate 132 can be determined by the ratio between the area of the slot 124 and the porosity of the porous plate 132.

The fluid flow 106 passes through the slot 124 and impinges on the rear surface of the vane plate 110 at the leading edge 112, and then passes through the gap 121 between the vane plate 110 and guide plate 120, being divided between the portion of the gap 121 extending adjacent the first leg 114 of the vane plate 110, and the portion of the gap 121 extending adjacent the second leg 116 of the vane plate 110.

This divided flow then exits through the first exhaust aperture 160 and the second exhaust aperture 170. The portion of the flow 106 exiting through the first exhaust aperture 160 flows over the first surface 152 of the vane body 150, while the corresponding remaining portion of the flow 106 exiting through the second exhaust aperture 170 flows over the second surface 154 of the vane body 150.

Figure 6:
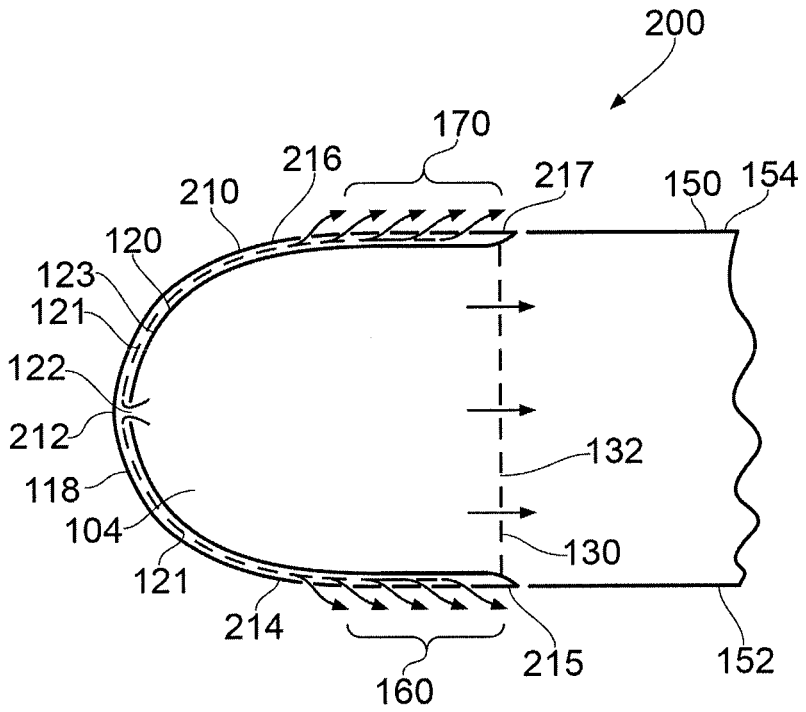
FIG. 6 shows a schematic sectional plan view of a vane according to a second embodiment of the disclosure.

Referring to FIG. 6, a vane according to a second embodiment of the disclosure is designated generally by the reference numeral 200. Features of the vane 200 which correspond to those of vane 100 have been given corresponding reference numerals for ease of reference.

The vane 200 comprises a vane plate 210, a guide plate 120 and a baffle 130. The vane plate 210 comprises a leading edge 212, a first leg 214 and a second leg 216. The first leg 214 and the second leg 216 respectively extend on opposing sides of the leading edge 212 to form a substantially U-shaped cross-sectional profile 218.

The vane 200 differs from the vane 100 in that the vane plate 210 is provided with a plurality of first exhaust apertures 160 that are positioned at the distal end 115 of the first leg 114 of the vane plate 110, and plurality of second exhaust apertures 170 that are positioned at the distal end 117 of the second leg 216 of the vane plate 210.

In use, the vane 200 functions in the same manner as that described above in relation to the vane 100. The fluid flow 106 passes through the slot 124 and impinges on the rear surface of the vane plate 210 at the leading edge 212, and then passes through the gap 121 between the vane plate 210 and guide plate 120, being divided between the portion of the gap 121 extending adjacent the first leg 214 of the vane plate 210, and the portion of the gap 121 extending adjacent the second leg 216 of the vane plate 210.

This divided flow then exits through the plurality of first exhaust apertures 160 and the plurality of second exhaust apertures 170. The portion of the flow 106 exiting through the plurality of first exhaust apertures 160 flows over the first surface 152 of the vane body 150, while the corresponding remaining portion of the flow 106 exiting through the plurality of second exhaust apertures 170 flows over the second surface 154 of the vane body 150.

Figure 7:
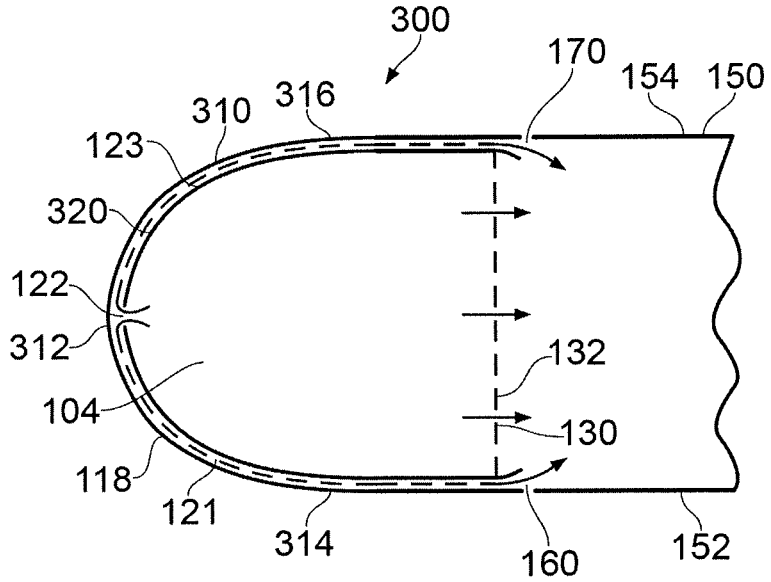
FIG. 7 shows a schematic sectional plan view of a vane according to a third embodiment of the disclosure.

Referring to FIG. 7, a vane according to a third embodiment of the disclosure is designated generally by the reference numeral 300. Features of the vane 300 which correspond to those of vane 100 have been given corresponding reference numerals for ease of reference.

The vane 300 comprises a vane plate 310, a guide plate 320 and a baffle 130. The vane plate 310 comprises a leading edge 312, a first leg 314 and a second leg 316. The first leg 314 and the second leg 316 respectively extend on opposing sides of the leading edge 312 to form a substantially U-shaped cross-sectional profile 318.

The vane 300 differs from the vane 100 in that each of the first exhaust aperture 160 and the second exhaust aperture 170 are arranged to exhaust the fluid flow passing through the gap 121 between the vane plate 110 and the guide plate 120 into the interior of the vane body 150.

Figure 8:
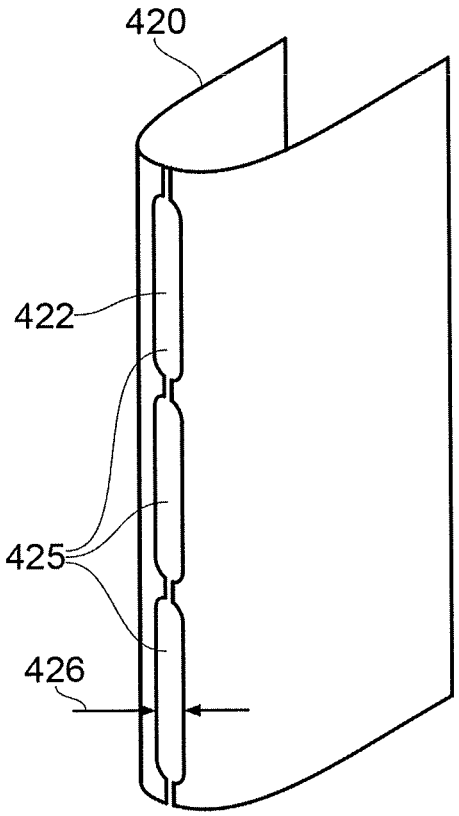
FIG. 8 shows a perspective view of a guide plate from a vane according to a fourth embodiment of the disclosure.

FIG. 8 shows a guide plate 420 forming part of a vane (400—not shown) according to a fourth embodiment of the disclosure. The guide plate 420 comprises a first aperture 422 that is formed as a plurality of axially arranged slots 425. In the arrangement shown in FIG. 8 each of the plurality of slots 425 has a uniform width 426.

In use, the vane 400 functions in the same manner as that described above in relation to the first embodiment of the disclosure.

Figure 9:
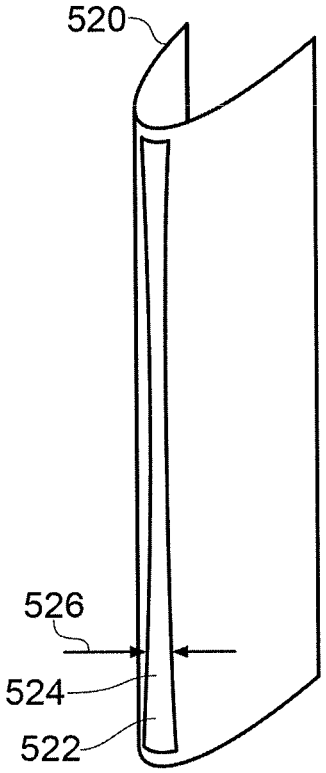
FIG. 9 shows a perspective view of a guide plate from a vane according to a fifth embodiment of the disclosure.

FIG. 9 shows a guide plate 520 forming part of a vane (500—not shown) according to a fifth embodiment of the disclosure. The guide plate 520 comprises a first aperture 522 that is formed as a tapered slot 524. In the arrangement shown in FIG. 9, the slot 524 has a width 526 that tapers decreasingly from a first value at one end to a minimum value at the mid-point of the slot 524, and then increases again to the first value at the opposite end. The slot taper is linear in this embodiment, although in other arrangements, the slot taper may be non-linear.

In use, the vane 500 functions in the same manner as that described above in relation to the first embodiment of the disclosure. In this arrangement, the tapered slot 524 serves to vary the distribution of the fluid flow passing therethrough over the length of the leading edge 112. In other words, the end regions of the leading edge 112 will receive a relatively higher proportion of the fluid flow than will the centre region of the leading edge 112.

Figure 10:
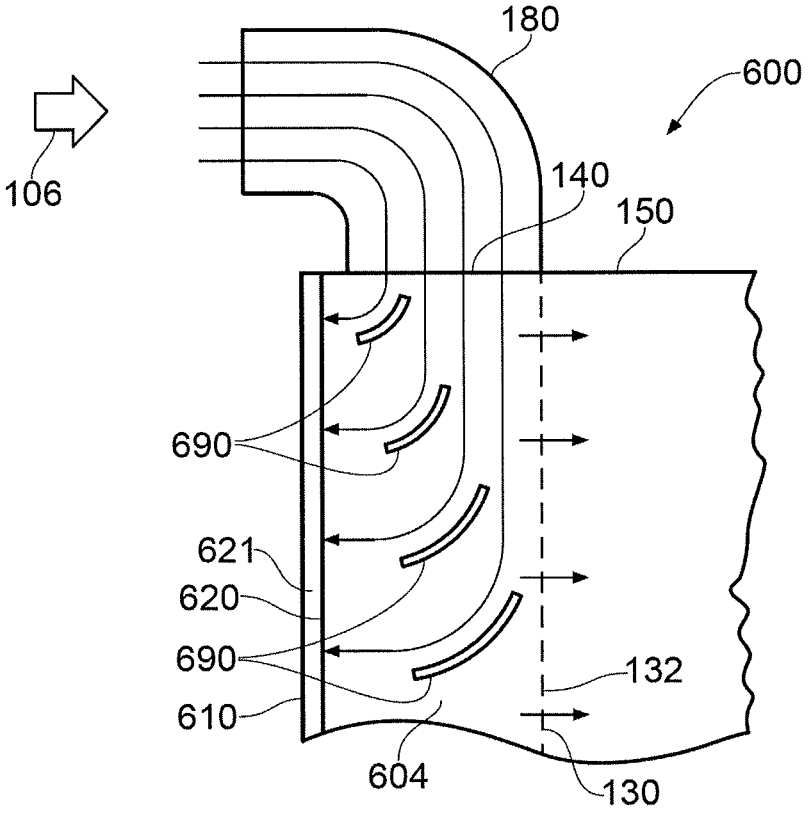
FIG. 10 shows a schematic cross-sectional view of a vane according to a sixth embodiment of the disclosure.

Referring to FIG. 10, a vane according to a sixth embodiment of the disclosure is designated generally by the reference numeral 600. Features of the vane 600 which correspond to those of vane 100 have been given corresponding reference numerals for ease of reference.

The vane 600 comprises a vane plate 610, a guide plate 620 and a baffle 130. The vane plate 610 comprises a leading edge 612, a first leg 614 and a second leg 616. The first leg 614 and the second leg 616 respectively extend on opposing sides of the leading edge 612 to form a substantially U-shaped cross-sectional profile 618.

The vane 600 further comprises a plurality of flow guide elements 190 arranged within the interior of the vane 604. Each of the flow guide elements 690 is formed as a curved plate. The flow guide elements 690 are positioned within the interior of the vane 604 to direct the fluid flow 106 entering the interior 604 of the vane towards the first aperture in the guide plate 620.

The vane of the present disclosure could be utilised throughout a gas turbine, wherever a surface protrudes into the hot gas path (e.g. nozzle guide vanes, stators, etc.). It is not limited to uses where only a small pressure difference is available: a higher pressure difference would simply allow more cooling flow to be driven through the system, increasing its effectiveness. Similarly, it is not limited to bypass air; other sources of cooling air could be used. A scoop is not necessary to deliver this cooling air; it could instead be transported to the vane leading edge by other means (e.g. piping). The vane of the present disclosure will also function with both gases and liquids; or a combination of the two.

The vane of the present disclosure could be applied to any system where one or more fluids of different temperatures are in close proximity and heat transfer must be controlled. This could include any surface crossing or protruding into a gas turbine hot gas path; or the leading edge of a re-entry, supersonic or hypersonic vehicle. There could also be applications in heat exchangers, reaction vessels, oil refineries and combustion plants; across the aerospace, automotive, nuclear and chemical industries.

Note that the vane of the present disclosure could also be used in cases where the fluid temperature differences described above are reversed; where the fluid travelling through the slot is used to warm the outer skin and surrounding structure. For example, the vane of the present disclosure could be used for de-icing an aerofoil surface using an engine bleed. Other uses might include inside refrigerant plants, expansion chambers, cryogenic systems, wind farms and high altitude aerospace applications including satellites and other space vehicles.

Further possible uses might include the rapid heating or cooling of mould surfaces in manufacturing.

The foregoing description of various aspects of the disclosure has been presented for s purposes of illustration and description. It is not intended to be exhaustive or to limit the disclosure to the precise form disclosed, and obviously, many modifications and variations are possible. Such modifications and variations that may be apparent to a person of skill in the art are included within the scope of the disclosure as defined by the accompanying claims.

What is claimed is:

1. A vane for an exhaust system duct in a gas turbine engine, the vane comprising:

a vane plate;

a guide plate; and a baffle, wherein the vane plate comprises a leading edge, a first leg and a second leg, the first and second legs respectively extending on opposing sides of the leading edge to form a substantially U-shaped profile, the guide plate being accommodated within the vane plate, the baffle extending between respective distal ends of the first and second legs, the guide plate comprising a first aperture extending along the guide plate and being aligned with the leading edge, the first aperture having a streamlined profile, such that edges of the first aperture curve around to extend into an interior of the vane, and the vane further comprising a fluid inlet arranged, in use, to direct a fluid flow from outside the duct into the interior of the vane, the vane further comprising a vane body and first and second exhaust apertures, the vane body having opposing first and second surfaces, the first and second surfaces being adjacent the respective distal ends of the guide plate, the first exhaust aperture being positioned at a juncture of the first surface and the guide plate adjacent the first leg, and the second exhaust aperture being positioned at a juncture of the second surface and the guide plate adjacent the second leg.

2. The vane as claimed in claim 1, wherein the first aperture is formed as a slot extending axially along the guide plate.

3. The vane as claimed in claim 2, wherein the slot has a width of between approximately 1 mm and 3 mm.

4. The vane as claimed in claim 2, wherein the slot has a width that varies along the axial extent of the slot.

5. The vane as claimed in claim 2, wherein the slot comprises a plurality of slots arranged axially along the guide plate.

6. The vane as claimed in claim 1, wherein the first aperture is formed as a plurality of perforations extending axially along the guide plate.

7. The vane as claimed in claim 1, wherein the baffle is formed as a porous plate.

8. The vane as claimed in claim 7, wherein the porosity of the baffle varies along the axial extent of the baffle.

9. The vane as claimed in claim 1, wherein each of the first and second exhaust apertures comprises a slot extending axially along the vane, each slot being arranged to direct a fluid flow from a gap between the vane plate and the guide plate, over respective ones of the first and second surfaces.

10. The vane as claimed in claim 1, wherein the fluid inlet comprises at least one scoop element arranged to direct a bypass fluid flow from outside the duct into the interior of the vane.

11. The vane as claimed in claim 1, the vane further comprising at least one curved plate arranged to direct a fluid flow from outside the duct through the first aperture and into a gap between the vane plate and the guide plate.

12. A gas turbine engine comprising a vane as claimed in claim 1.

13. A vane for an exhaust system duct in a gas turbine engine, the vane comprising:

a vane plate;

a guide plate; and a baffle, wherein the vane plate comprises a leading edge, a first leg and a second leg, the first and second legs respectively extending on opposing sides of the leading edge to form a substantially U-shaped profile, the guide plate being accommodated within the vane plate, the baffle extending between respective distal ends of the first and second legs, the guide plate comprising a first aperture extending along the guide plate and being aligned with the leading edge, the vane further comprising:

a vane body and first and second exhaust apertures, the vane body having opposing first and second surfaces, the first and second surfaces being adjacent the respective distal ends of the guide plate, the first exhaust aperture being positioned at a juncture of the first surface and the guide plate adjacent the first leg, and the second exhaust aperture being positioned at a juncture of the second surface and the guide plate adjacent the second leg; and a fluid inlet arranged, in use, to direct a fluid flow from outside the duct into an interior of the vane.

* * * * *